US006662099B2

(12) United States Patent
Knaian et al.

(10) Patent No.: US 6,662,099 B2
(45) Date of Patent: Dec. 9, 2003

(54) WIRELESS ROADWAY MONITORING SYSTEM

(75) Inventors: Ara N. Knaian, Cambridge, MA (US); Joseph A. Paradiso, Medford, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 18 days.

(21) Appl. No.: 09/862,381

(22) Filed: May 22, 2001

(65) Prior Publication Data

US 2002/0177942 A1 Nov. 28, 2002

(51) Int. Cl.[7] ..... G08G 1/09

(52) U.S. Cl. ..... 701/117; 701/118; 701/115; 340/905; 340/917; 340/933; 340/941

(58) Field of Search ..... 701/117, 118, 701/119; 340/905, 917, 933, 941

(56) References Cited

U.S. PATENT DOCUMENTS

| | | | | | |
|---|---|---|---|---|---|
| 3,803,570 | A | | 4/1974 | Barlow et al. | 340/235 |
| 3,882,381 | A | * | 5/1975 | Gregory | 324/665 |
| 4,229,726 | A | * | 10/1980 | Deaton et al. | 340/933 |
| 5,491,475 | A | * | 2/1996 | Rouse et al. | 324/244 |
| 5,523,950 | A | * | 6/1996 | Peterson | 340/905 |
| 5,748,108 | A | * | 5/1998 | Sampey et al. | 200/86 A |
| 5,757,288 | A | * | 5/1998 | Dixon et al. | 340/933 |
| 5,880,682 | A | * | 3/1999 | Soulliard et al. | 324/207.13 |
| 5,889,477 | A | | 3/1999 | Fastenrath | 340/905 |
| 6,011,508 | A | * | 1/2000 | Perreault et al. | 246/122 R |
| 6,075,466 | A | * | 6/2000 | Cohen et al. | 340/933 |
| 6,137,424 | A | * | 10/2000 | Cohen et al. | 340/933 |
| 6,140,941 | A | * | 10/2000 | Dwyer et al. | 235/384 |
| 6,178,374 | B1 | | 1/2001 | Mohlenkamp et al. | 701/117 |
| 6,384,739 | B1 | * | 5/2002 | Roberts, Jr. | 340/905 |
| 6,411,889 | B1 | * | 6/2002 | Mizunuma et al. | 340/928 |

OTHER PUBLICATIONS

Knaian, A.N., "A Wireless Sensor Network for Smart Roadbeds and Intelligent Transportation Systems", Thesis, M.I.T. Dept. of Electrical Engineering and Computer Science (Jun. 2000).

(List continued on next page.)

*Primary Examiner*—William A. Cuchlinski, Jr.
*Assistant Examiner*—Eric Gibson
(74) *Attorney, Agent, or Firm*—Testa, Hurwitz & Thibeault, LLP

(57) ABSTRACT

A wireless, in-road traffic sensor system using sensors that are small, low-cost, and rugged. The sensors may be capable of measuring the speed of passing vehicles, identifying the type of passing vehicle and measuring information about roadway conditions, e.g., wet or icy. The sensor includes a wireless transmitter and may be configured for installation beneath a roadway surface. The sensors may be configured as a traffic sensor system including distributed sensors across a roadway system, concentrators for receiving the sensor broadcasts and a central computer for accumulating and organizing the sensed information. The sensed information may also be made available responsive to user requests via the Web through such reports as traffic delays, alternate route planning and travel time estimates. Alternatively, the sensed information may also be used to control traffic through a traffic control means, such as a traffic signal.

58 Claims, 8 Drawing Sheets

OTHER PUBLICATIONS

Caruso, M., Withanawasam, L., "Vehicle Detection and Compass Applications using AMR Magnetic Sensors," Honeywell Solid State Electronics Center, 12001 State Highway 55, Plymouth, MN (1999).

Schrank, D., Lomax, T., "The 1999 Annual Mobility Report," Texas Transportation Institute, Texas A&M University System (1999).

Lockheed Martin Federal Systems, "National ITS Architecture Documents: Executive Summary; U.S. Department of Transportation," EDL #5388, U.S. Government Printing Office (Dec. 1999).

Palen, J., "The Need For Survaillance in Intelligent Transportation Systems, Part II," Intellimotion, vol. 6, No. 2 (1997).

Beymer, D., McLauchlan, P., Coifman, B., Malik, J., "A Real–Time Computer Vision System for Measuring Traffic Patrameters," In Proc. Computer Vision and Pattern Recognition, Association for Computing Machinery, pp. 495–501 (1997).

Sun, C., "Intelligent Surveillance Using Inductive Vehicle Signatures," Intellimotion, vol. 8, No. 3 (Mar. 1999).

"HP–II Series Transmitter Module Design Guide," Linx Technologies, 575 S.E. Ashley Place, Grants Pass, OR (1999, revised Feb. 1, 2000).

Graham–Rowe, D., "Danger, Hazard ahead!," New Scientist, vol. 160, No. 2160 (Nov. 14, 1998).

"Vehicle Identification System (VIS) for Access Control" (Web document downloaded on Apr. 18, 2001—date otherwise not available).

"Groundhog Permanent Traffic Counter," Web page (http://www.nu–metrics.com/pages/01prods.htm) (2001—a more specific date is not available).

Nu–metric's Groundhog Permanent Traffic Counter specifications (2001—a more specific date is not available).

* cited by examiner

WIRELESS ROADWAY MONITORING SYSTEM

FIELD OF THE INVENTION

The invention relates generally to roadway monitoring systems and more specifically to in-road, wireless roadway monitoring systems.

BACKGROUND OF THE INVENTION

The level of traffic congestion on roadways is a serious problem imposing excessive burdens upon commuters in terms of commute time, stress, fuel consumption and vehicle wear and tear. Reports suggest that the amount of congestion-induced delay experienced by the average commuter in a large city such as Los Angeles or Boston has more than doubled over a span of less than two decades.

Given the practicalities of driving habits and limited capital resources, the most realistic near-term approaches to reducing road congestion involve improvements to current roadways. For example, an initiative underway at the National Intelligent Transportation Systems (ITS) utilizes information technology to make better use of existing roads. One particularly compelling system envisioned by ITS workers is the Automated Traveler Information System (ATIS). Before embarking on a trip, drivers could consult a Web page to obtain accurate trip time estimates for various departure times and modes of transportation. Upon embarking, a dynamic route guidance system would provide them with turn-by-turn directions based on up-to-the minute information about roadway speeds and congestion levels.

At the very least, this type of system would allow drivers to make better route decisions, to be confident that they were taking the most efficient route, and to plan their activities around traffic delays. One of the largest obstacles to the implementation of this type of system is the shortage of accurate, real-time traffic data. Currently available traffic sensor systems (e.g., video, sonar, radar, inductive, magnetic, capacitive, polyvinylidine fluoride (PVDF) wire, pneumatic treadle) use significant electrical power, so each sensor must be connected to a power distribution network. For sensors that are installed on electrical poles (video, sonar, radar), the installation cost per sensor can be several hundred dollars. For cabled sensors that are installed in the roadway receiving power and/or communicating via cables, (inductive, magnetic, PVDF wire, capacitive, pneumatic treadle) the installation cost per sensor can be several thousand dollars. Inroad sensors are currently utilized in certain "trouble spots" because they are very accurate, provide direct information with very little ambiguity, can monitor road conditions (e.g., presence of ice), and do not require a human operator. But their high cost discourages the widespread deployment that would be necessary for large-scale monitoring networks.

SUMMARY OF THE INVENTION

In general, the present invention provides a low-power, wireless, in-road traffic sensor system using sensors that are small, low-cost, and rugged. The sensors may be capable of measuring the speed of passing vehicles, in addition to measuring information about roadway conditions, e.g., wet or icy. Each sensor may be configured to consume so little power that it can operate from a small internal battery for up to 10 years. The low cost and ease of installation allows communities to outfit entire roadway systems, thus providing a viable near-term solution for managing roadway traffic congestion.

Accordingly, in a first aspect, the invention comprises a wireless roadway sensor configured for installation beneath a roadway surface. The sensor includes a sensing element capable of sensing roadway conditions, such as the presence of a vehicle on the roadway, an average speed of vehicles on the roadway, types of vehicles on the roadway, and water and/or ice on the roadway. The sensor also includes a wireless transmitter for periodically broadcasting sensed information to a remote destination.

In one embodiment, the sensor includes a magnetic sensing element for sensing vehicles on the roadway through perturbations in the ambient magnetic field. In another embodiment, the sensor includes a capacitive sensor element for sensing precipitation on the roadway through the electrical measures, such as the dielectric constant and the conductivity at the roadway surface. In yet another embodiment, the sensor includes a temperature sensor element for sensing the temperature of the roadway and, in conjunction with the precipitation sensor, inferring the presence of road-surface ice.

In another aspect, the invention comprises a wireless roadway sensor that includes a sensing element for sensing a roadway condition and a wireless transmitter for transmitting the sensed information to a remote destination. The wireless transmitter communicates with the sensor and periodically broadcasts the sensed information on a communication channel using a randomized multiplexing scheme. The randomized multiplexing scheme allows the channel to be shared with other sensors broadcasting in accordance with the scheme.

In one embodiment, the transmitter is a narrowband radio-frequency (RF) transmitter. In another embodiment, the transmitter is configured to modulate a RF carrier signal using frequency-shift-keying modulation. In yet another embodiment, the sensor is configured to use a receiverless protocol, further reducing its power consumption.

In yet another aspect, the invention comprises a wireless roadway sensing and information-integration system. This system includes multiple sensors distributed across a roadway system. The sensors are organized into sets each including one or more sensors. Each of the sensors includes a sensing circuit for sensing at least one roadway condition and a wireless transmitter for periodically broadcasting the sensed information. The system also includes a number of concentrators for receiving the sensor broadcasts, whereby each concentrator receives broadcasts from the sensors of one of the sets. The system also includes a computer in communication with the concentrators. The computer is configured to accumulate and organize the sensed information obtained by the sensors.

In one embodiment the computer determines traffic volume through vehicle counts reported by the sensors. In another embodiment, the computer determines alternate routes responsive to traffic congestion being sensed along an initially-planned route. In yet another embodiment, the computer includes a Web server communicating over the Internet for providing the sensed roadway information responsive to Web client requests.

In yet another aspect, the invention comprises a method for controlling traffic whereby a sensor is installed beneath a roadway surface for sensing a roadway condition. The sensor, in turn, transmits information relevant to the sensed condition through periodic wireless broadcasts to a remote receiver for actuating a traffic-controlling device.

BRIEF DESCRIPTION OF THE DRAWINGS

The invention is pointed out with particularity in the appended claims. The advantages of the invention may be better understood by referring to the following description taken in conjunction with the accompanying drawing in which:

DETAILED DESCRIPTION OF THE INVENTION

1. Roadway Sensor

Figure 1:
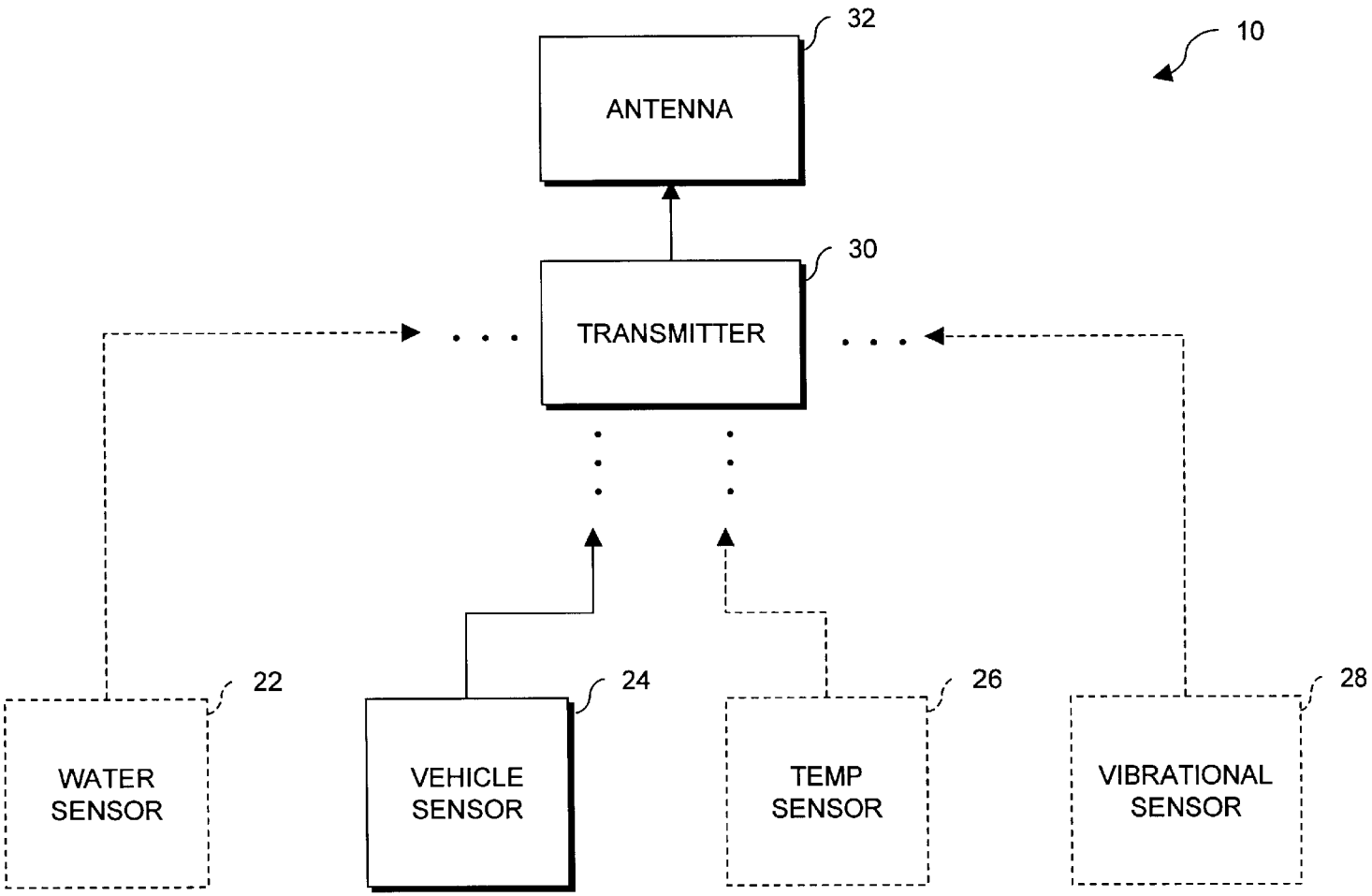
FIG. 1 is a block diagram depicting an embodiment of the invention.

Referring to FIG. 1, one embodiment of an in-road traffic sensor 10 includes a vehicle sensor 24, a transmitter 30 and an antenna 32. In some embodiments, the in-road traffic sensor 10 includes additional sensors shown in phantom, such as a water sensor 22 for sensing the presence of precipitation on the roadway, a temperature sensor 26 for sensing the roadway temperature and a vibrational sensor 28 for sensing the vibrations of passing vehicles on the roadway. The temperature sensor 26 may be used in conjunction with the water sensor 22 to detect the presence of ice on the roadway, while the vibrational sensor 28 may be used to categorize passing vehicles through their vibration signatures (e.g., differentiating between automobiles, motorcycles and trucks).

Each of the sensors 22, 24, 26, 28 (generally 20) is in electrical communication with the transmitter 30, and each provides an output signal relating to the respective sensed information. Generally, the transmitter 30 transforms the information received from the sensors 20 into a form suitable for wireless communication via the antenna 32, and broadcasts the transformed information to a remote destination through wireless transmissions. The sensor information is typically available as baseband electrical signals, such as voltage or current levels, or sequences of binary digits, or bits, of information.

In general, the antenna 32 may be any transducer capable of converting electrical into wireless broadcast signals. Examples of transducers include antennas, such as those typically used in wireless radio frequency (RF) communications; electrical-optical converters, such as light emitting diodes, lasers, photodiodes; and acoustic devices, such as piezoelectric transducers. In a preferred embodiment, the antenna 32 is an electrical antenna 32, designed for operation in the frequency range between 30 MHz and 3,000 MHz, generally known as the ultrahigh frequency (UHF) band. The UHF frequency band is particularly well suited to the in-road sensor 10 application because UHF circuits and components are relatively small in size and consume relatively low power. For example, physical limitations in antenna construction typically result in antennas being scaled to approximately one-half the wavelength of operation. The half-wavelength ranges from 5 meters to 5 cm in the UHF band.

In a particularly preferred embodiment, the antenna 32 is a microstrip patch antenna 32 operating within the frequency range of 902 MHz to 928 MHz. Microstrip patch antennas 32 are relatively small compared with other resonant antennas, such as dipole antennas, operating over the same frequency range. Microstrip patch antennas 32 are also rugged, easily designed and fabricated and relatively inexpensive. Although it may be desirable to operate at even higher frequencies, other considerations, such as government regulation, may stand in the way. For example, transmitting RF signals within certain frequency bands may be prohibited altogether, while use of other frequency bands may be restricted to special users, such as airlines or the military. Operation within the 902 MHz to 928 MHz frequency band is largely available for industrial, science and medical applications.

The in-road traffic sensor 10 may be configured for installation beneath a roadway. The sensor 10 is particularly well suited to such an installation because of its compact size and its ability to operate without external interconnects, e.g., connections to the electrical power grid or to a receiver. Furthermore, the sensor 10 may be configured in a single, self-contained and environmentally-sealed package. The sensor 10 may be installed completely beneath the roadway surface or partially beneath the roadway surface, with some portion of the sensor 10 (e.g., the antenna 32) exposed to the road surface. The sensor 10 may be installed during the initial surfacing of a roadway, or through a retrofit of an existing roadway surface. With currently available components, a sensor 10 may be configured to have a volume of less than one cubic inch. Installation of such a sensor 10 requires minimal disturbance to an existing roadway. Other embodiments are possible, e.g., in which the sensor is installed on top of the roadway, similar to roadway reflectors and lane markers in multi-lane roads; but surface installations may not be advisable where the roadways are cleared by snow plows.

Figure 2:
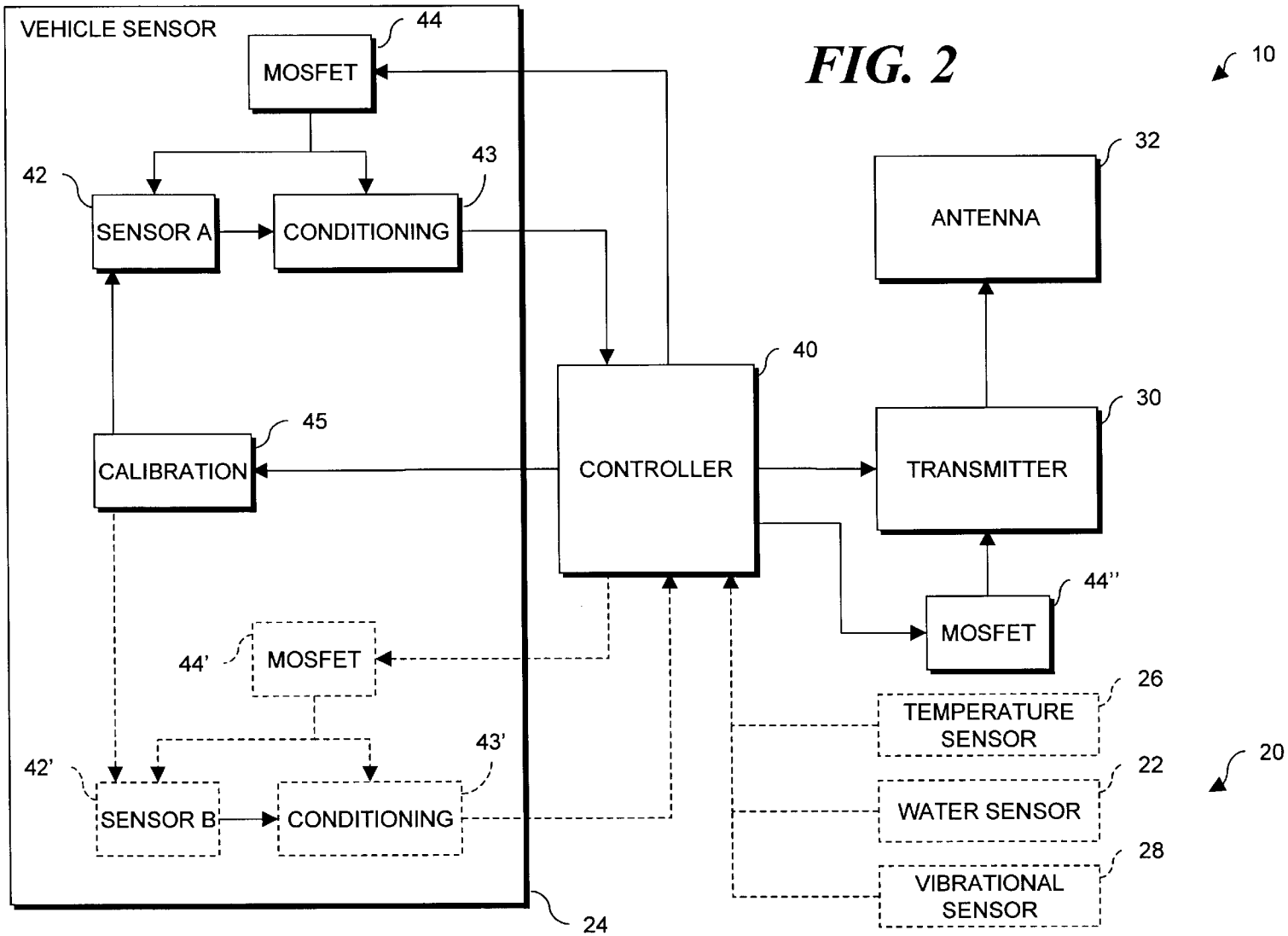
FIG. 2 is a more detailed block diagram depicting the embodiment of the invention shown in FIG. 1.

In more detail, referring to FIG. 2, one embodiment of an in-road traffic sensor 10 includes a controller 40 in communication with each of the sensors 20 and with the transmitter 30. The controller 40, the sensors 20 and the transmitter are also connected to a power source (not shown) such as an internal or parasitic electrical power source. Interconnections to the power source may be established through one or more power control devices 44, 44', 44" (generally 44) offering the advantage of controlling and sharing power in an efficient manner. In one embodiment, the vehicle sensor 24 includes a vehicle sensing element 42 ("sensor A") and a signal conditioning circuit 43 receiving signals from the sensing element 42. The vehicle sensing elements may also require a calibration device 45 to provide a bias, or offset, or to perform a calibration function for the sensing element 42. The vehicle sensor 24 may also include a second vehicle sensing element 42' ("sensor B"), shown in phantom, to provide improved reliability through redundancy or, more typically, to support additional sensing capabilities, such as sensing the direction and average speed of vehicles passing the sensor 10.

The controller 40 typically performs central control functions for the in-road traffic sensor 10. The controller 40 may also perform other overhead functions, such as input/output (I/O) communications control, data formatting, power management, timing and synchronization.

In one embodiment, the signal conditioning circuit 43 includes an instrumentation amplifier having a low-voltage supply requirement and having a fast settling time; a suitable device is the INA155 component (Burr-Brown device number) manufactured by Texas Instruments Inc., Dallas, Tex. For embodiments where the sensor 42 generates a differential signal, the instrumentation amplifier also converts it to a single-ended signal. In some embodiments, the output from the instrumentation amplifier is amplified further by an operational amplifier, such as device number OP162, manufactured by Analog Devices, Norwood, Mass.

As previously mentioned, the vehicle sensor 24 receives power from the local electrical power source through the power control device 44. One power control device 44 may provide power to both the amplifier circuit 43 and the vehicle sensing element 42, or separate power control devices 44 may be used. The vehicle sensing element 42 receives electrical power and senses a roadway condition that varies in relation to the presence of a vehicle on the roadway, providing an electrical output signal relating to the sensed information. In some embodiments, the output signal from the vehicle sensing element 42 may require conditioning, such as amplification, filtration, or conversion, such as analog to digital (A/D) conversion. Where signal conditioning is required, the vehicle sensing element output signal may be input into the amplifier circuit 43. The controller 40 receives the conditioned vehicle sensing signal and may perform processing thereon. Signal processing may include determining the presence of a vehicle, counting the numbers of sensed vehicles and buffering any information to be broadcast. In one embodiment, the controller 40 provides an output signal corresponding to the vehicle sensor output signal to the transmitter 30. The controller 40 may also provide timing, monitoring, and control information to the transmitter 30 to frequency tune the transmitter, to control the periods of broadcast, and the like. The transmitter 30 broadcasts the information provided by the controller 40, under the control of the controller 40, to a remote destination. The transmitter may also receive electrical power through a controllable power device 44". The transmitter 30 may be configured to transmit information periodically, such as when an event is sensed, e.g., a vehicle passing the sensor 10, or periodically after some time delay where sensed information is buffered within the sensor 10.

Vehicle sensing elements 42 may require the application of an external signal for calibration or to establish an offset bias. These functions are provided by the calibration device 45, which is in communication with the vehicle sensing element 42 and the controller 40. The calibration device 45 receives an input signal from the controller 40 and in response applies an output signal to the vehicle sensor element 42 in accordance with the needed calibration or offset function.

In one embodiment, the electrical power source for the sensor 10 is a battery (not shown) capable of powering the entire sensor 10. In one embodiment, the electrical power is applied to the sensors 20 and to the transmitter 30 through the power control devices 44. In a preferred embodiment, the battery is compact and capable of storing a substantial charge for a relatively long time, e.g., several years. In a preferred embodiment, the battery is a lithium battery such as a lithium thionyl-chloride battery.

The power control devices 44 receive input power from the power source, provide power to a load through an output, and are capable of being operated to control the amount of power delivered to the load. In some embodiments, the power control device 44 is a transistor. In a preferred embodiment, the power control device is a P-channel enhancement mode, metal-oxide semiconductor field effect transistor (MOSFET), such as device number Si2301 manufactured by Siliconix Inc., Santa Clara, Calif. The power control device 44 may be controlled by the controller 40 through a control port. It is advantageous to control the power to the different elements of the sensor 10 in order to limit the overall power consumption. In particular, dynamically redistributing power to the different elements of the sensor 10 preserves the limited available power from the power source. Indeed, an in-road traffic sensor 10 of the kind described herein might be capable of operating for up to ten years with a single, compact battery source. For example, where the transmitter transmits periodically, power is required during periods of transmission and not during idle periods.

In some embodiments, the in-road traffic sensor 10 is equipped with a second vehicle sensing element 42', a second amplifier circuit 43'and a second power control device 44'. The second vehicle sensing element 42'and related components 43', 44'are configured similarly to the first vehicle sensing element 42. The second vehicle sensing element may be included to improve reliability by providing redundancy, or to allow for the computation of vehicle direction and average speed through two independent, spatially separated measurements. The other optional sensors 22, 26, 28 are shown in phantom and may be interconnected to the power source, to the controller 40 and to the transmitter 30 in a similar manner as the vehicle sensor 24.

Figure 4:
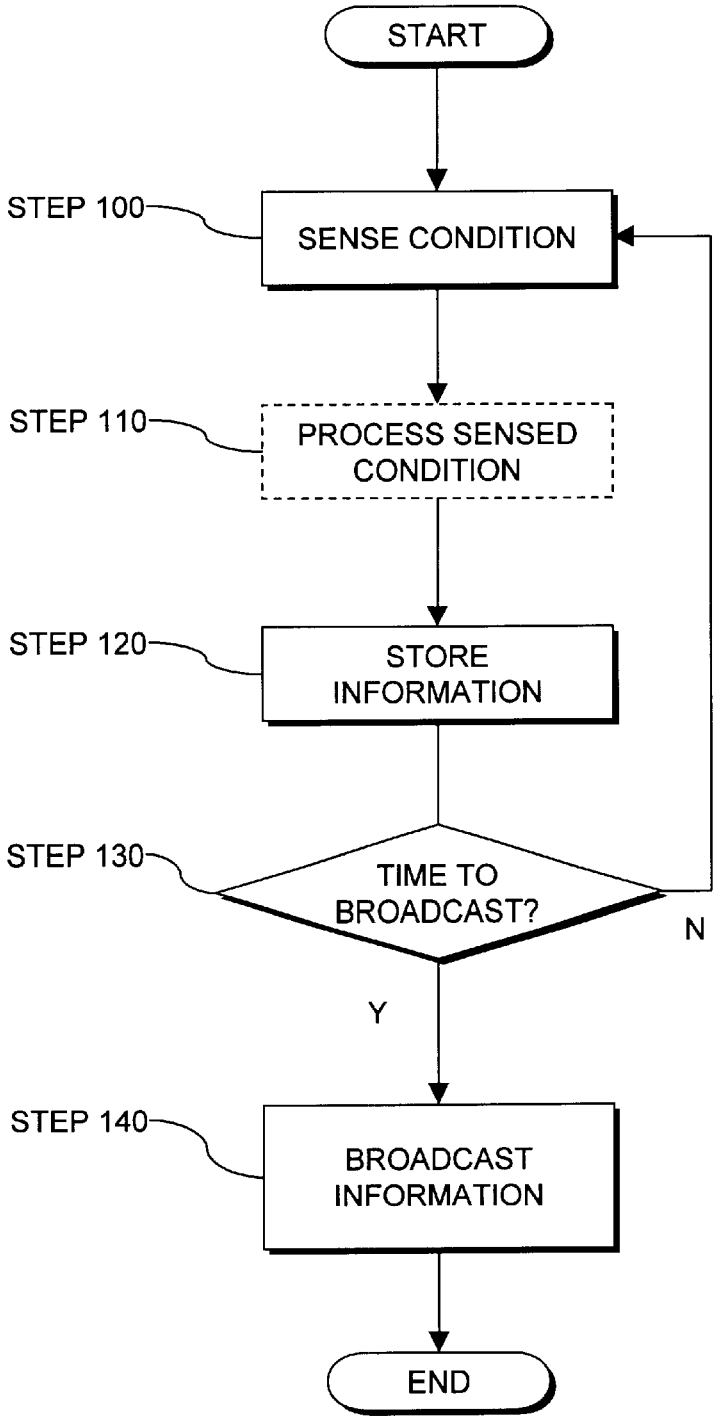
FIG. 4 is a flow chart of an embodiment of a method in accordance with the invention.

In operation, referring to FIG. 4, the sensors 20 senses a roadway condition, such as the presence of a vehicle, and/or the presence of water or ice on the road surface (step 100). Optionally, the sensors 20 may process the sensed information, or provide the sensed information directly to the controller 40 for processing, or processing may occur at both the sensors 20 and at the controller 40 (step 110). Processing may include signal conditioning, such as amplification, attenuation, or filtering; or signal conversion, such as A/D conversion. Processing may also include manipulation of the sensed information to determine other roadway conditions. For example, where the sensor is equipped with two vehicle sensing elements 42, 42', processing may be used to determine the direction of traffic depending on which sensing element 42, 42' first reports the presence of the vehicle. Processing may also be used to determine the average speed of a passing vehicle by dividing the baseline separation of the two sensors 42, 42' by the time difference that the vehicle is sensed by each sensor 42, 42'. Additional processing may be used to determine the presence of surface water, ice or snow through capacitive measurements of the water sensor 22 and temperature measurements of the temperature sensor 26. For example, ice will be detected if the water detector 22 detects the presence of surface water while the temperature sensor detects that the surface temperature is below the freezing point of water. Additionally, processing may include the characterization of vibrations sensed by the vibrational sensor 28 into vehicle classifications.

In an application where the sensor 10 periodically transmits information to a remote destination, the sensed and processed information may be temporarily buffered. At any instant of time, the transmitter may be either actively transmitting or not transmitting, or silent. During periods of transmission, the transmitter transmits some or all of the information from the buffer (step 130). Periodic transmissions are well adapted to applications where relatively small amounts of data are transferred and offer the advantages of both power conservation and efficient utilization of limited frequency bandwidth. In one embodiment, the transmitter uses a sparse time division multiple access (TDMA) multiplexing protocol to support multiple sensors 10 each sensor 10 transmitting sensed information to a remote destination on the same frequency (step 140).

1-a. Vehicle Sensing

In one embodiment, the vehicle sensing element 42 senses the presence of vehicles on the roadway by sensing perturbations to the ambient magnetic field. In a preferred embodiment, the vehicle sensing element 42 is an anisotropic magnetoresistive sensing element, such as device number HMC1021S, manufactured by Honeywell, Plymouth, Minn. Magnetoresistive sensing elements, when immersed in a magnetic field, convert the magnetic field into a voltage output, such as a differential output voltage. Typically, magnetoresistive sensing elements are relatively small (e.g., standard, 8-pin dual-inline package and smaller), low cost, highly reliable and capable of sensing low-level magnetic fields (e.g., 30 micro-gauss). Anisotropic magnetoresistive sensors are typically made from a thin film of nickel-iron (PERMALLOY) patterned onto a silicon wafer as a resistive strip. The HMC1021S device includes a Wheatstone bridge with one leg of the bridge having such a strip. When a potential of 3.0 volts is applied to the bridge, and the on-axis magnetic field strength can be read across the bridge as a voltage of 3.0 millivolts/gauss. Other suitable vehicle sensors include inductive sensors, pressure sensors, vibration sensors, optical sensors, and other active sensors communicating with the passing vehicles.

1-b. Environmental Sensing

Roadway environmental conditions amenable to detection in accordance with the present invention may include, for example, precipitation, ice, salinity, and vibration. Referring to FIG. 1, precipitation may be sensed with the water sensor 22, whereas ice may be sensed with the water sensor 22 in conjunction with the temperature sensor 26. The temperature sensor 26 senses the temperature of the roadway and provides an output signal to the transmitter corresponding to the sensed temperature value. In one embodiment the temperature sensor 26 is a calibrated thermocouple device. The thermocouple, when suitably biased, provides an output voltage that corresponds to the temperature of the thermocouple junction. In a preferred embodiment, the temperature sensor 26 is a precision analog output complementary metal-oxide semiconductor (CMOS) integrated-circuit temperature sensor, such as device number LM20 manufactured by National Semiconductor Corp. Santa Clara, Calif. In one embodiment, power may be provided to the temperature sensor 26 through the controller 40. The output of the temperature sensor may be low-pass filtered and received by the controller 40, which may convert the signal into digital form through an A/D converter.

In one embodiment, the water sensor 22 uses a capacitive element to infer the dielectric or conductive properties of the material above the sensor. This approach is well known to those skilled in the art and offers distinct advantages of detecting water reliably at low cost and without consuming a significant amount of power. The capacitance may be measured through a minimally-complicated circuit, such a circuit measuring high-to-low and low-to-high voltage transition times between the assertion of a signal on a microcontroller pin and the corresponding voltage transition at an associated sensor plate connected to the microcontroller pin across a high impedance (e.g., several MΩ). Other well-known capacitive measuring techniques may also be used, such as switched capacitor techniques, relaxation oscillator techniques, heterodyning techniques, transmit-receive coupling techniques, etc.

Additional information as to the condition of a roadway may be determined through a sensor configured to measure the conductivity at the roadway surface. In one embodiment, exposed capacitive leads are placed in contact with the road surface and may be used to sense the road-surface conductivity. Determination of the road-surface conductivity through such a contact method facilitates the inference of road-surface conditions, such as the presence of precipitation and/or whether the roadway has been treated, such as with an ice inhibitor (e.g., salt). In other embodiments, the roadway surface sensor 10 may be configured to measure the complex impedance of material on the roadway, e.g., through alternating current (AC) measurements, RF measurements or switched capacitor techniques, such as the QPROX sensor system manufactured by Quantum Research Group Limited, Pittsburgh, Penn. Time-varying measurement techniques such as these would preclude any need to expose conductive electrodes directly to the environment.

An vibrational sensor 28 may include a piezoelectric transducer sensing element converting pressure variations into electrical signals. The electrical signal may be amplified and conditioned, in a manner similar to that already described for the vehicle sensor 24. Different categories of vehicle typically impart different vibrations to the roadway surface depending on such factors as the weight of the vehicle, the type of motor and wheels, etc. The output signal of the vibrational sensor 28 may be related to categories of vehicle based on, for example, peak or average amplitude values, the amplitude profile, the duration, and spectral content. Ranges of these parameters associated with different types of vehicle may be stored within sensor 28 in the form of a database, which is addressed when signals are detected. In some embodiments the vibrational sensor 28 may include an in-air or contact microphone, such as an electret microphone (e.g., the model EM9765-422 manufactured by Horn Industrial Co. Ltd., Shenzhen, Guangdong, China, or the model WM-54B, manufactured by Panasonic Industrial Company, Secaucus, N.J.). In other embodiments, accelerometers may be used to detect vibrations, such as the model ADXL202 dual-axis, low power, low voltage, digital output accelerometer, manufactured by Analog Devices. Other components and implementational details are described in Knaian, *A Wireless Sensor Network for Smart Roadbeds and Intelligent Transportation Systems* (graduate thesis on file at Massachusetts Institute of Technology), the entirety of which is hereby incorporated by reference.

In some embodiments, the vibrational sensor 28 may include a low power, or even passive (i.e., consuming virtually no power) acoustic or acceleration sensing element. The vibrational sensor 28 may be used to enhance the power conservation features of the in-road traffic sensor 10. In such an application, the sensor 10 may operate in a default low-power operational mode, or inactive mode, where elements of the sensor, including the magnetic field sensing element, are normally inactive. When the vibrational sensor 28 senses through roadway vibrations that a vehicle may be approaching, the vibrational sensor 28 transmits a signal to other elements of the sensor 10, e.g., to the microcontroller 40, to activate the other elements of the sensor 10. In this way, vibrations resulting from an approaching vehicle cause a suitably configured sensor 10 to activate and operate as previously described (e.g., sensing the vehicle through perturbations to the ambient magnetic field). The vibrational sensor 28 may also be configured to transmit a signal to the microcontroller 40 after some predetermined period of inactivity to resume low-power operation (e.g., return to a "sleep mode").

1-c. Transmitter

Figure 3:
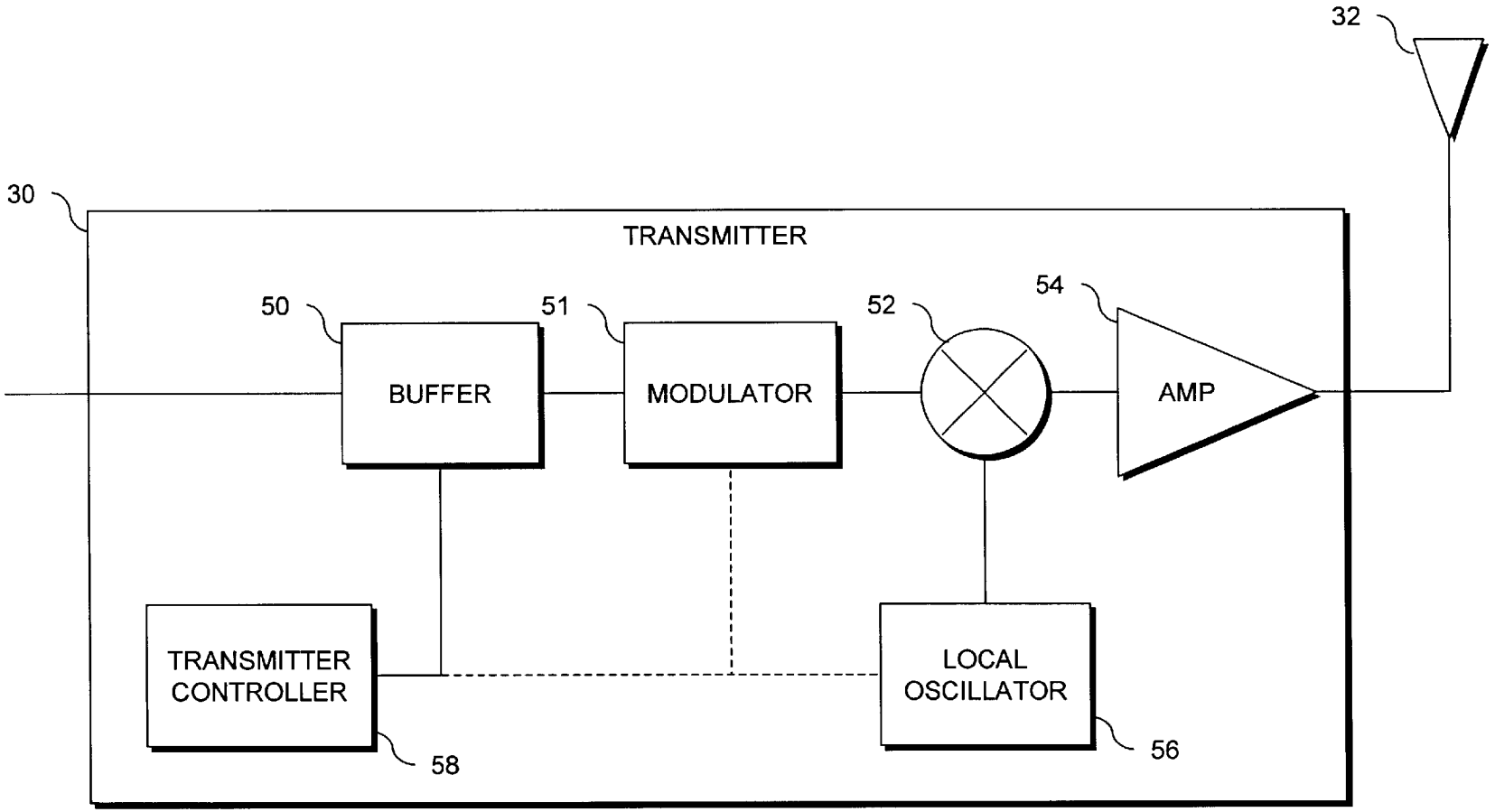
FIG. 3 is a block diagram depicting the transmitter of the embodiment shown in FIG. 1.

Referring to FIG. 3, the transmitter 30 includes a buffer 50 for receiving and storing information from the sensors 20.

Alternatively, a buffer may be included within the controller 40 shown in FIG. 2. The transmitter 30 also includes a modulator 51 for modulating a carrier signal with information derived from the sensors 20. The transmitter 30 also includes a mixer 52 for translating the modulated signal to a desired RF frequency of operation, an amplifier 54 amplifying the transmitted signal to a sufficient signal strength to support wireless communications with the remote destination, a local oscillator 56 for supplying a reference signal, and a controller 58 for controlling the overall operation of the transmitter 30. Alternatively, the functions of the controller 58 may be performed by the sensor controller 40 shown in FIG. 2.

The buffer 50 receives sensed information from the controller 40, and provides the sensed information as an output signal to the modulator 51. The modulator 51, in turn, is in communication with the RF amplifier 54 through the mixer 52, and may be in electrical communication with the modulator 51 and the local oscillator 56 (interconnections shown in phantom).

The information received by the buffer 50 originates with the sensors 20. The buffer 50 temporarily stores the received sensor information until the transmitter broadcasts the information. The modulator 51 receives a first signal containing baseband data received from the buffer 50. The modulator 51 impresses the received baseband data of the first signal onto a second signal, which may be an intermediate signal having a dominant frequency component other than the baseband signal or the RF signal; the intermediate signal is transformed to an RF broadcast signal before exiting the transmitter 30. Alternatively, the second signal may be the broadcast signal itself. For example, in an RF transmitter 30, the baseband signal may be a relatively low-frequency signal, e.g., 2400 bits per second (bps). This signal is provided to the modulator 51 and the modulator, in turn, changes some aspect of an intermediate signal, such as an audio-frequency (10,000 Hz) tone, or the broadcast signal, such as a 928 MHz RF signal. The modulator 51 may change the amplitude, the frequency, or the phase of the intermediate signal according to the baseband data.

In a preferred embodiment, the transmitter 30 is a frequency shift keying (FSK) transmitter. The FSK transmitter 30 modulates a tone between two or more frequencies according to the value of the baseband data. For example, a baseband input of a binary "0" into the modulator 51 may result in an intermediate 10,000 Hz signal output. Likewise, a baseband input of a binary "1" into the modulator 51 may result in an intermediate 20,000 Hz signal. The modulator output is a signal having an instantaneous frequency of either 10,000 Hz or 20,000 Hz, depending on whether the output corresponds to a binary "0" or a binary "1", respectively. Preferably the amplitude of the envelope of the modulator output signal is also substantially constant. The modulated intermediate signal at the output of the modulator 51 is translated to an RF broadcast signal suitable for broadcast through the antenna 32. In some embodiments, the transmitter may be frequency agile, while in other embodiments, the transmitter may be a spread-spectrum transmitter, using such techniques as frequency hopping or code division multiple access (CDMA).

The mixer 52 has three ports: an intermediate frequency (IF) input port, a local oscillator (LO) input port, and an RF output port. The IF port of the mixer 52 receives the modulated intermediate signal from the modulator 51. The LO port of the mixer 52 receives an RF reference signal from the local oscillator 56. The mixer 52 produces an output substantially corresponding to the sum and difference of the signals at the IF port and the LO port (i.e., the local output signal frequency of the oscillator 56 and the intermediate signal frequency).

The amplifier 54 amplifies the RF broadcast signal to an amplitude suitable for wireless transmission to an intended external destination through the antenna 32. The amplifier may be a standard RF amplifier and may include a filtration stage to filter any unwanted output products of the mixer 52. For example, where the intermediate frequency is 10,000 Hz and the local oscillator 56 frequency is 928 MHz, the output of the mixer 52 would be 928.010 MHz and 927.990 MHz. The amplifier 54 filtration stage may attenuate the unwanted of the two mixer output signals (e.g., 927.990 MHz) while amplifying the other (e.g., 928.010 MHz).

Generally, operating multiple sensors 10 within the same general proximity may result in unwanted interference. For example, if two sensors 10 communicating with the same remote destination broadcast information at the same time and on the same frequency, neither signal may be discernable and the transmissions will be lost. Interference may be avoided by using multiplexing techniques, such as assigned frequencies or assigned broadcast intervals for individual sensors 10. In one embodiment, the transmitter 30 is configured to operate according to a sparse-TDMA transmission protocol. The sparse-TDMA protocol includes a master time interval (e.g., 60 seconds) that is arbitrarily divided up into a number of time slots (e.g., 7693 time slots, each of 7.8 milliseconds duration). In one embodiment, each sensor 10 may randomly select a time slot and broadcast its information in that slot. With each transmitter 30 operating according to such a protocol, the probability of interference can be maintained at a sufficiently manageable level.

The transmitter 30 may be configured to inhibit a transmission responsive to the vehicle sensor 24 during the time that a vehicle is directly over the sensor 10, since overhead vehicles can reduce the probability of reception of a wireless transmission at a remote destination. In some embodiments, the vehicle sensor 24 may transmit a signal to the transmitter 30, or to the microcontroller 40, indicating that a vehicle may be located on the roadway above the sensor 10. The transmitter 30, or the microcontroller 40 having received such a signal, may in turn respond by inhibiting normal transmissions. The inhibited transmissions may be stored and transmitted at a later time.

1-d. Receiver

In some embodiments, the in-road traffic sensor 10 includes a wireless receive capability. A suitably configured receiver receives wireless signals through the antenna 32 and converts the wireless signals into electrical signals. Such a receive capability is particularly useful for performing remote diagnostics or remote repair (e.g., receiving updated system firmware). Since the receive capability represents another power dissipation source, the receive capability may be configured to operate periodically. For example, the receiver may routinely operate only during a predetermined duration of time and according to a predetermined period (e.g., the receiver operates for five minutes each day at 12 o'clock). Occasionally, any extended periods of operation that may be required, such as during a firmware upgrade, could be negotiated during the routinely occurring operational periods.

1-e. Vehicle Counting Algorithm

Figure 5:
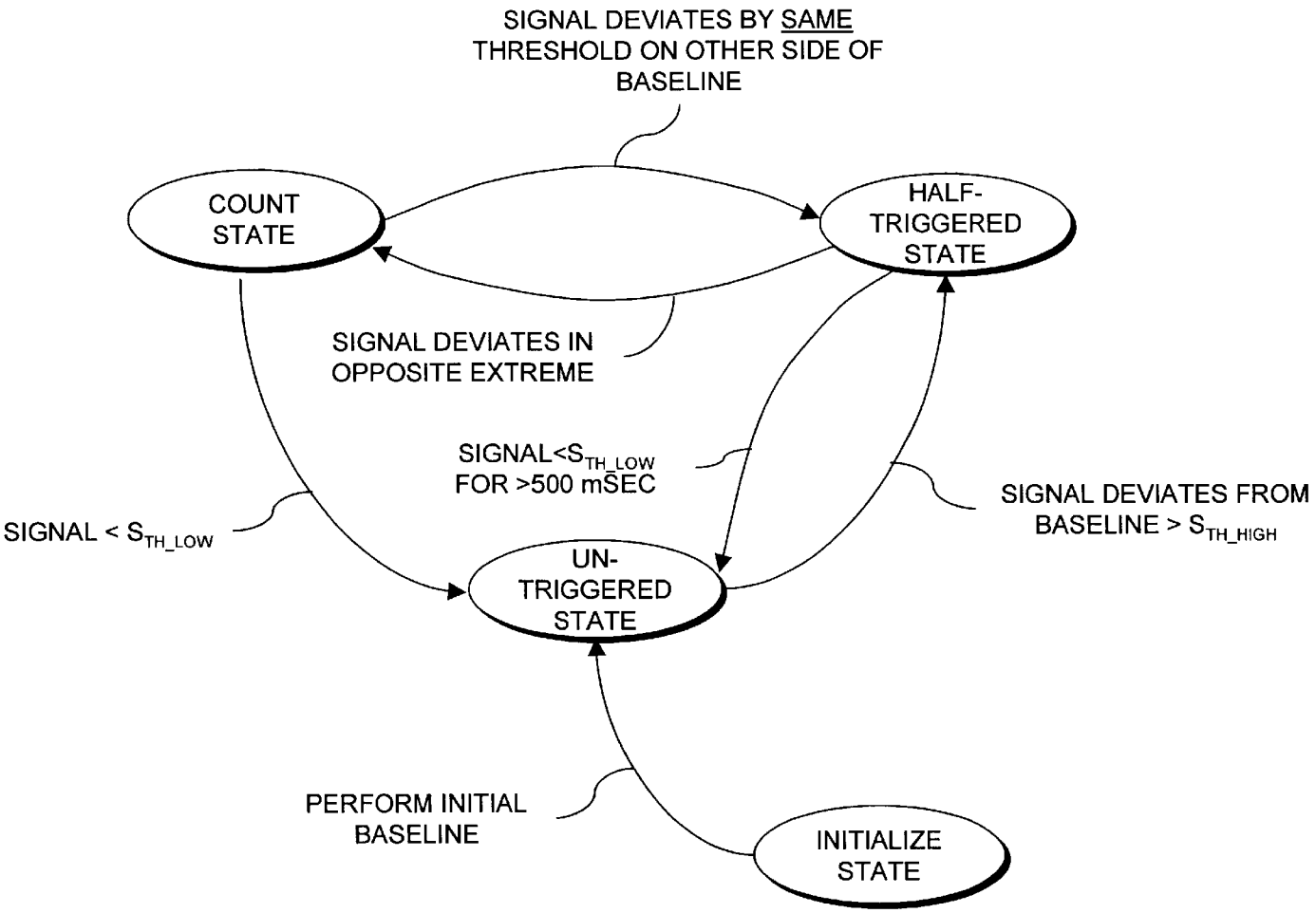
FIG. 5 is a block diagram depicting the operational states of the embodiment of the invention shown in FIG. 1.

Referring to FIG. 5, in one embodiment, the in-road traffic sensor 10 includes a state machine for counting passing vehicles. The state machine may be driven by the variation in the vehicle sensor output signal with respect to a baseline value. Generally, the magnetic field will vary in a similar fashion for a vehicle passing over the sensor, increasing from a baseline value to a maximum excursion in one direction (e.g., positive), followed by an excursion to a similar maximum value, but to the opposite side of the baseline (e.g., negative). In one embodiment, the state machine begins in an untriggered state. When the signal deviates by more than a first threshold ("$S_{TH_}^{LHIGH}$") from the baseline, the state machine progresses to a half-triggered state. If the signal deviates by more than the same threshold, but on the opposite side of the baseline, the state machine progresses to the count state, and a counter may be advanced indicating that a vehicle has passed the sensor. Before the state machine can count another vehicle, it must be first returned to either the untriggered state or again to the half-triggered state. When the signal comes within a second threshold ("$S_{TH_}^{LOW}$"), smaller than the first threshold, the state machine transitions to the untriggered state and available to repeat the process when the next vehicle passes. If the state machine is in the half-triggered state and the signal reduces below the second threshold for a period of time greater than a predetermined minimum, e.g., 500 milliseconds, without reaching the first threshold in the opposite side of the baseline, the state machine is returned to the untriggered state. The state machine may also return to the half-triggered state directly from the count state, if the signal deviates again to the opposite extreme.

In one embodiment, the baseline value is established during initial power on over a period of time, e.g., 10 seconds. When the state machine is untriggered, the measurement baseline is continuously adjusted to compensate for changes in the ambient magnetic field and to maintain measurement fidelity. For example, the measurement baseline may be adjusted upward by some amount, e.g., 1/10 of a count per sample, if the signal is above the baseline and downward by some amount, e.g., 1/10 of a count per sample, if the signal is below the baseline. When the state machine is in any state other than the untriggered state, the baseline may be adjusted in a similar manner, but using a smaller increment, e.g., 1/100 of a count per sample.

2. Roadway Sensing System

Figure 6:
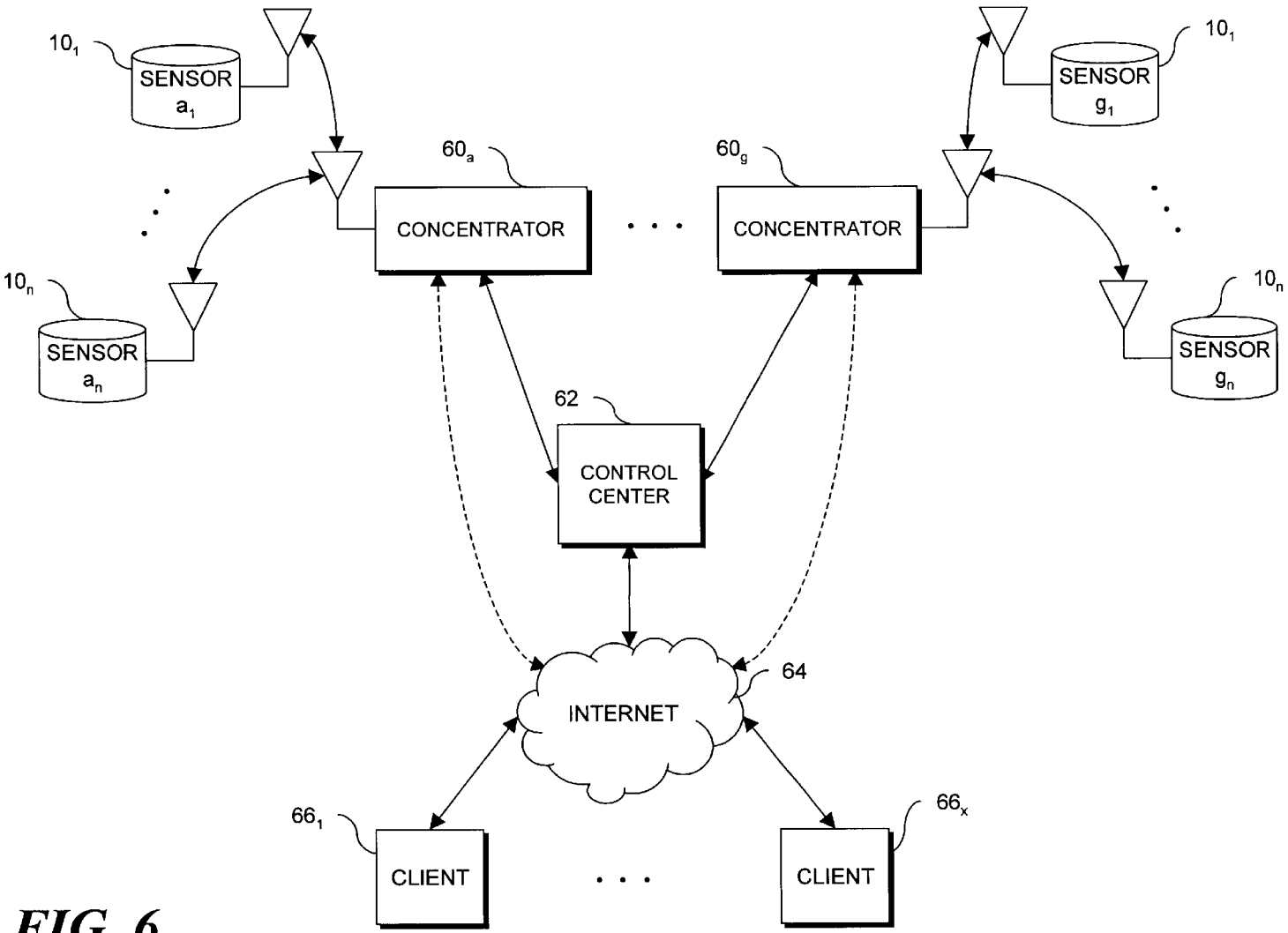
FIG. 6 is a block diagram depicting a traffic monitoring and reporting system embodiment of the invention.

Referring to FIG. 6, the in-road traffic sensors 10 may be used to monitor several roadway segments, or an entire roadway system. In a roadway sensing system, the sensors 10 provide information relating to traffic and roadway conditions to a central location where the data may be processed, stored and made available to serve several traffic management objectives. In one embodiment, groups of sensors indicated at $\mathbf{10}_1, \ldots \mathbf{10}_n$ are organized into sets (of n sensors each, for simplicity, it being understood that different sets may have different numbers of sensors) and installed across a roadway system. Each set contains one or more sensors 10, and the sensor(s) $\mathbf{10}_1, \ldots \mathbf{10}_n$ of a set of sensors broadcasts sensed information to a common concentrator 60. Generally, each of the concentrators serves one set of sensors 10. Suppose, for example, that the system includes seven sets "a" through "g." A concentrator $\mathbf{60}_a$ receives signals from sensor set a, i.e., sensors a, through an, while the last concentrator $\mathbf{60}_g$ receives signals from sensor set g, i.e., sensors $g_1$ through $g_n$. The sensors 10 communicate with the concentrators 60 through wireless communications, allowing the concentrators 60 to be located remotely from the sensors 10. The concentrators 60 may, for example, be located at an elevated vantage point such as on a telephone pole, or traffic signal pole. Placing the concentrators 60 at such convenient locations allows them to be powered remotely, e.g., by means of electrical power lines, rather than imposing an internal power requirement.

Each of the concentrators 60, in turn, may communicate with a centrally located control center 62. Communications between the concentrators 60 and the control center 62 may also be established with available telephone lines, dedicated communications lines, cellular telephone communications, or radio communications. The control center 62 may combine information from the various concentrators 60 into an overall picture of roadway conditions and delays for the covered region. Roadway sensor information may also be made available to a larger audience by placing the sensed information on a communications network, such as through a Web application hosted on the Internet 64. Having the roadway information available on the Web allows Web clients $\mathbf{66}_1, \ldots, \mathbf{66}_x$ (generally 66) to access up-to-date roadway information on demand.

2-a. Roadway Monitoring System

Figure 7:
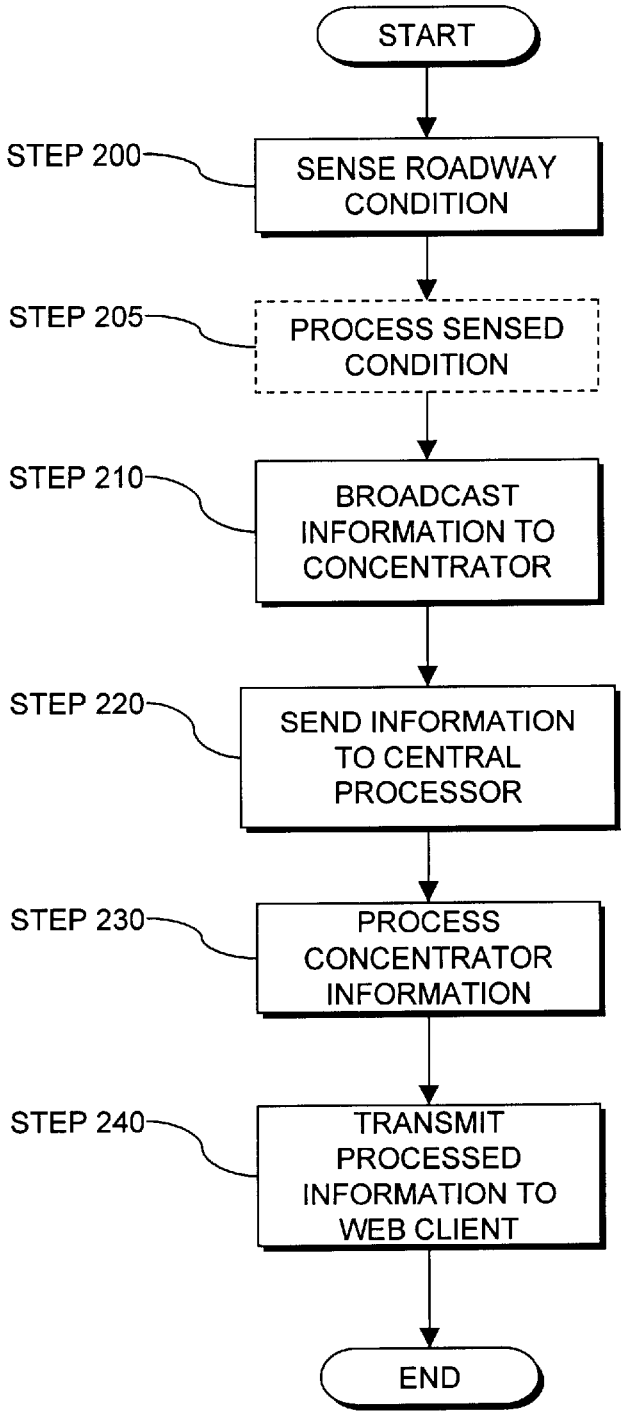
FIG. 7 is a flow chart of an embodiment of a method in accordance with the invention shown in FIG. 6.

In operation, referring to FIG. 7, each of the roadway sensors 10 senses roadway information as previously discussed (step 200). Each of the sensors 10, assigned to one of the sensor sets, may further process the sensed information (step 205) and broadcast the information to a concentrator 60 corresponding to its sensor set (step 210). The concentrators 60, in turn, send the received information from the sensors 10 to the control center 62 (step 220). At the control center 62, further processing may be performed (step 230). Control center processing may include, for example, estimating travel time for particular routes, identifying alternate routes to both avoid and manage traffic congestion, generating traffic signal control signals, and determining roadway surface conditions.

2-b. Web Server

As already mentioned, the sensor information and processed sensor information may be made available on the Web through a Web server application. In one embodiment, a Web application may be provided offering access to roadway sensed information as processed by the control center 62. Alternatively, the concentrators 60 may be interconnected directly to the Internet 64, facilitating Web-based access thereto. This may serve as the basis upon which the control center 62 communicates with the concentrator 60, or may allow Web clients to obtain information directly from the concentrators 60.

The control center 62 may respond to Web client requests for traffic service in the form of a traffic report, travel route time estimate, or travel route planning to avoid traffic congestion, preparing the requested product and serve it to the requesting Web client 66. The control center 62 may make use of information routinely collected from the sensors 10, serving a Web client request with the latest available information. Alternatively, the control center 62 may request updates from the concentrators 60 relevant to the Web client request.

3. Traffic Control System

Figure 8:
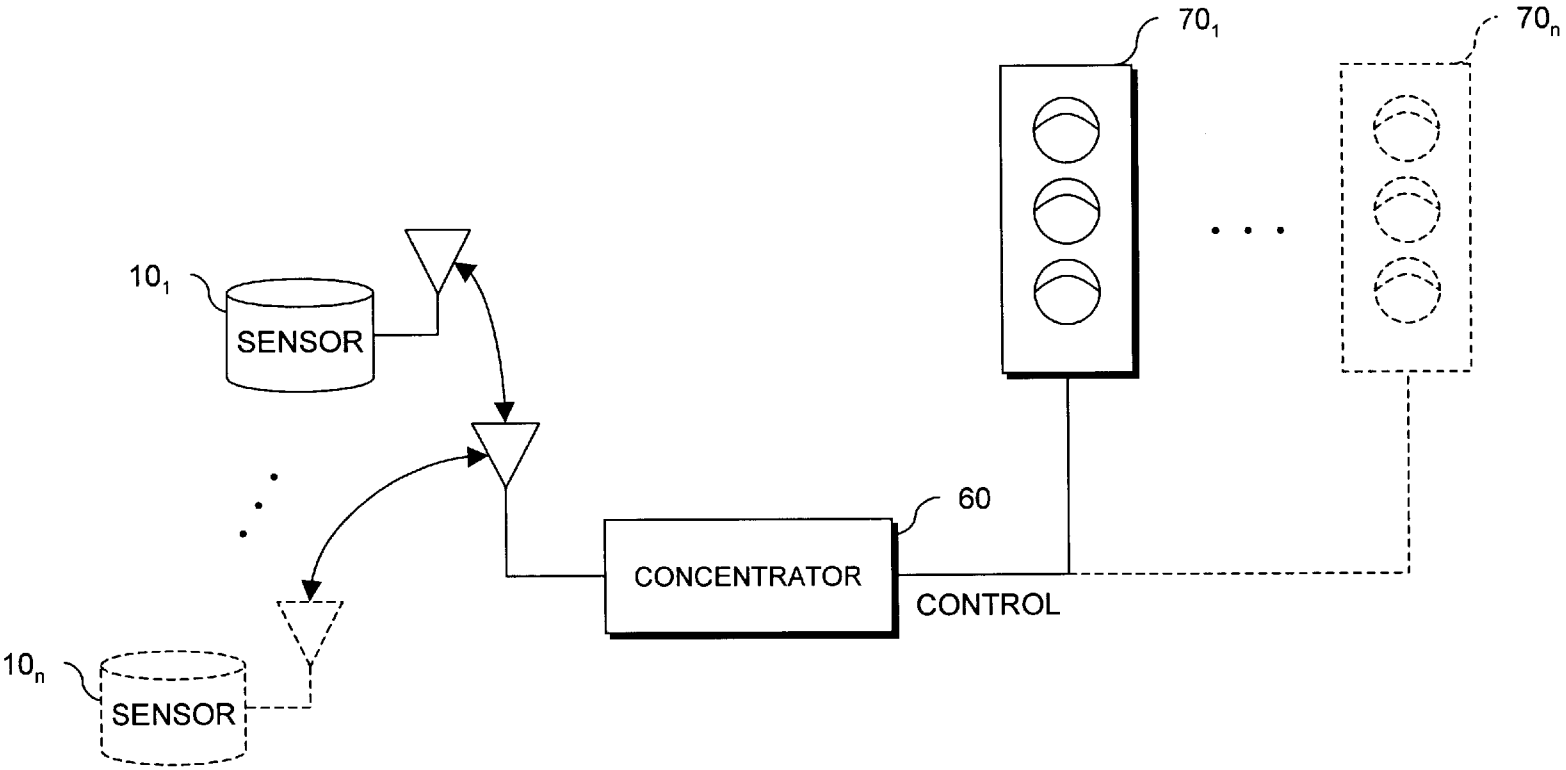
FIG. 8 is a block diagram depicting a traffic monitoring and control embodiment of the invention.

Referring now to FIG. 8, the in-road traffic sensors 10 may be configured to control traffic. A set of sensors, $\mathbf{10}_1, \ldots \mathbf{10}_n$ (generally 10) are placed at strategic locations around a segment of roadway. The sensors 10 sense passing vehicles as previously described and broadcast information to the concentrator 60 associated with the respective set of sensors 10. The concentrator 60, in response to the received vehicle information from the sensors 10, controls one or more traffic control mechanisms $\mathbf{70}_1 \ldots \mathbf{70}_n$ (generally 70). The traffic control mechanism 70 may, as illustrated, include traffic lights. For example, at a roadway intersection, one or more sensors 10 may be placed in each lane approaching the intersection. As vehicles approach the intersection, the sensors 10 detect the passing vehicles and broadcast related information to the common concentrator 60. The concentrator may be located on a light pole or telephone pole as previously indicated, typically in the general vicinity of the intersection. Alternatively, the concentrator may be located at a more remote distance from the sensors 10 limited only by the restrictions of the wireless communications link from the sensors 10 to the concentrator 60.

In this application, it is advantageous for each of the sensors 10 provide some form of identification allowing the concentrator 60 to distinguish which sensor 10 is reporting a passing vehicle. Identification means may include broadcasting a unique address tone, or bit sequence, broadcasting in a pre-assigned time slot, or broadcasting on an allocated frequency. The concentrator 60, being able to identify the reporting sensor 10, is thereby apprised of which portion of the roadway segment (e.g., which lane) contains the approaching vehicle and can control the traffic lights 70 accordingly. Because the wireless communications link distances may be greater than one kilometer, it is possible to have a single concentrator controlling traffic flow at a number of different roadway segments. Integrating information from contiguous chains of segments can facilitate the control of overall traffic flow over relatively large metropolitan areas to avoid gridlock.

Having shown the preferred embodiments, one skilled in the art will realize that many variations are possible within the scope and spirit of the claimed invention. It is therefor the intention to limit the invention only by the scope of the claims.

What is claimed is:

1. A wireless roadway sensing apparatus comprising:

a sensor configured for installation beneath a roadway surface, the sensor, when so installed, sensing at least one of (i) a vehicle on the roadway passing the sensor, (ii) an average speed of vehicles on the roadway passing the sensor, (iii) types of vehicles on the roadway passing the sensor, (iv) water on the roadway, and (v) ice on the roadway; and a wireless transmitter, in communication with the sensor, for periodically broadcasting sensed information according to a receiverless protocol comprising a sparse time-division-multiple-access, randomized-time-of-transmission protocol.

2. The apparatus of claim 1 wherein the sensor comprises a magnetic-field sensor sensing perturbations in an ambient magnetic field.

3. The apparatus of claim 2 wherein the magnetic-field sensor is a magnetoresistive magnetic field sensor.

4. The apparatus of 2 further comprising circuitry for adjusting the magnetic-field sensor.

5. The apparatus of claim 1 wherein the sensor comprises circuitry for determining an approximate speed of a vehicle on the roadway passing the sensor.

6. The apparatus of claim 5 wherein the speed-determining circuitry comprises first and second magnetic-field sensors, each of the first and the second magnetic-field sensors sensing a vehicle on the roadway passing the respective sensor.

7. The apparatus of claim 6 wherein the speed determining circuitry determines the approximate speed of a vehicle on the roadway passing the sensor responsive to a time difference between sensing a vehicle by the first sensor and sensing of the vehicle by the second sensor.

8. The apparatus of claim 1 further comprising a counter for counting numbers of vehicles on the roadway passing the sensor.

9. The apparatus of claim 1 wherein the wireless transmitter is a narrowband transmitter.

10. The apparatus of claim 9 wherein the narrowband transmitter is configured to transmit a frequency-shift-keying signal.

11. The apparatus of claim 1 wherein the wireless transmitter is a spread-spectrum transmitter.

12. The apparatus of claim 1 wherein the wireless transmitter operates substantially within a frequency band spanning 300 MHz to 3,000 MHz.

13. The apparatus of claim 12 wherein the wireless transmitter operates substantially within a frequency band spanning 902 MHz to 928 MHz.

14. The apparatus of claim 1 wherein the sensor comprises a precipitation sensor for sensing precipitation on the roadway.

15. The apparatus of claim 14 wherein the precipitation sensor comprises circuitry for sensing at least one of capacitance, permittivity, and conductivity.

16. The apparatus of claim 1 wherein the sensor comprises an ice sensor for sensing ice on the roadway.

17. The apparatus of claim 16 wherein the ice sensor comprises circuitry for sensing a temperature of the roadway.

18. The apparatus of claim 1 wherein the sensor comprises vehicle-detection circuitry for detecting the types of vehicles on the roadway passing the sensor.

19. The apparatus of claim 18 wherein the vehicle-detection circuitry comprises a vibrational sensor for sensing vibrations.

20. The apparatus of claim 19 wherein the vibrational sensor is an acoustic sensor for sensing pressure variations.

21. The apparatus of claim 19 wherein the vibrational sensor is an accelerometer for sensing acceleration.

22. The apparatus of claim 1 further comprising diagnostic circuitry for diagnosing sensor status.

23. The apparatus of claim 1 further comprising calibration circuitry.

24. The apparatus of claim 1 wherein the sensor comprises sensing, control and transmission circuitry, the circuitry ordinarily operating in an inactive mode, the sensing circuit being configured to sense an approaching vehicle and in response, to cause the circuitry to enter an active mode.

25. The apparatus of claim 1 wherein the sensor is configured to detect a vehicle over the sensor, the transmitter being configured to suppress transmission when vehicles are overhead.

26. A method for sensing roadway information comprising the steps of:

(a) installing a sensor beneath a roadway surface, the sensor, when so installed, sensing at least one of (i) vehicles on the roadway passing the sensor, (ii) an average speed of vehicles on the roadway passing the sensor, (iii) types of vehicles on the roadway passing the sensor, (iv) water on the roadway, and (v) ice on the roadway; and (b) transmitting sensed information by means of periodic wireless broadcasts broadcasting sensed information according to a receiverless protocol that comprises a sparse time-division-multiple-access protocol.

27. The method of claim 26 wherein the sensor senses vehicles on the roadway passing the sensor through perturbations in an ambient magnetic field.

28. The method of claim 27 wherein the magnetic-field sensor comprises a magnetoresistive magnetic field sensor.

29. The method of claim 26 wherein the sensor determines an approximate speed of a vehicle on the roadway passing the sensor.

30. The method of claim 29 further comprising the step of installing a second sensor beneath the roadway surface, each of the sensors sensing a vehicle on the roadway passing the respective sensor, the sensors being spaced in relation to each other along a baseline, the baseline being substantially collinear with a direction of traffic flow.

31. The method of claim 30 comprising the steps of:

(a) measuring a time difference between a vehicle being sensed at one sensor and the same vehicle being sensed at the other sensor; and (b) determining the vehicle speed by dividing the baseline separation distance by the measured time difference.

32. The method of claim 26 further comprising the step of counting a number of vehicles on the roadway passing the sensor.

33. The method of claim 26 wherein the step of transmitting sensed information comprises transmitting a narrowband signal.

34. The method of claim 33 wherein the narrowband signal is a frequency-shift-keying signal.

35. The method of claim 26 wherein the step of transmitting sensed information comprises transmitting a spread-spectrum signal.

36. The method of claim 26 wherein the step of transmitting sensed information comprises transmitting a radio-frequency signal within a frequency band spanning 300 MHz to 3,000 MHz.

37. The method of claim 36 wherein the step of transmitting sensed information comprises transmitting a radio-frequency signal within a frequency band spanning 902 MHz to 928 MHz.

38. The method of claim 26 wherein the sensor senses water through measurement of at least one of capacitance, permittivity, and conductivity.

39. The method of claim 26 wherein vehicles on the roadway passing the sensor are detected by means of an acoustic sensor sensing pressure variations.

40. A wireless roadway sensing apparatus comprising:

a sensor configured to sense at least one roadway condition; and a wireless transmitter in communication with the sensor, the wireless transmitter being responsive to the sensor and periodically broadcasting sensed information on a communication channel by means of a randomized multiplexing scheme, the multiplexing scheme allowing the channel to be shared with other sensors broadcasting in accordance with the scheme.

41. The apparatus of claim 40 wherein the sensor is configured to sense perturbations in an ambient magnetic field.

42. The apparatus of claim 40 wherein the sensor is configured to sense roadway-surface precipitation.

43. The apparatus of claim 40 wherein the sensor is configured to sense roadway-surface ice.

44. The apparatus of claim 40 wherein the wireless transmitter is a radio frequency transmitter.

45. The apparatus of claim 40 wherein the randomized multiplexing scheme comprises a sparse time-division-multiple-access protocol.

46. A method for sensing roadway information comprising the steps of:

(a) sensing at least one roadway condition; and (b) transmitting sensed information on a communication channel through periodic wireless broadcasts by means of a randomized multiplexing scheme, the multiplexing scheme allowing the channel to be shared with other sensors broadcasting in accordance with the scheme.

47. The method of claim 46 wherein the sensing step comprises sensing perturbations in an ambient magnetic field.

48. The method of claim 46 wherein the sensing step comprises sensing roadway-surface precipitation.

49. The method of claim 46 wherein the sensing step comprises sensing roadway-surface ice.

50. The method of claim 46 wherein the transmitting step comprises transmitting a wireless radio frequency signal.

51. The method of claim 46 wherein the transmitting step comprises transmitting the sensed information according to a sparse time-division-multiple-access protocol.

52. The method of claim 46 further comprising:

(c) receiving transmitted sensed information at a server computer connected to the Internet; and (d) providing requested information in response to Internet-based requests relating to sensed information.

53. The method of claim 52 wherein step (c) comprises:

(c-1) receiving transmitted sensed information at a concentrator; and (c-2) transmitting received information to a central computer comprising a server connected to the Internet.

54. A method for controlling traffic comprising the steps of:

(a) installing a sensor beneath a roadway surface, the sensor, when so installed, sensing a roadway condition;

(b) transmitting information relevant to the sensed condition through periodic wireless broadcasts on a communication channel according to a receiverless protocol by means of a randomized multiplexing scheme comprising a sparse time-division-multiple-access protocol; and (c) actuating, in accordance with the broadcasts, a traffic-controlling device responsive thereto.

55. The method of claim 54 wherein the sensor senses vehicles on the roadway passing the sensor.

56. The method of claim 54 wherein the sensor senses vehicles by sensing perturbations in an ambient magnetic field.

57. The method of claim 54 wherein the traffic-controlling device comprises a traffic light.

58. The method of claim 54 further comprising the steps of:

(a) installing a plurality of additional sensors beneath the roadway surface at different locations, the sensors, when so installed, sensing the roadway condition and transmitting information relevant to the sensed condition through periodic wireless broadcasts; and (b) receiving the broadcasts at a concentrator, the traffic controlling device being responsive to the concentrator.

* * * * *